United States Patent [19]

Edelhoff

[11] Patent Number: 4,917,246

[45] Date of Patent: Apr. 17, 1990

[54] STACKABLE, STABLE AND SHOCKPROOF PARALLELEPIPEDIC CONTAINER

[75] Inventor: Gustav-Dieter Edelhoff, Iserlohn, Fed. Rep. of Germany

[73] Assignee: Edelhoff Polytechnik GmbH & Co., Heckenkamp, Fed. Rep. of Germany

[21] Appl. No.: 41,337

[22] Filed: Apr. 22, 1987

[30] Foreign Application Priority Data

Apr. 30, 1986 [DE] Fed. Rep. of Germany ..... 3614767

[51] Int. Cl.[4] ..... B65D 45/16

[52] U.S. Cl. ..... 206/511; 220/1.5; 220/325; 220/327

[58] Field of Search ..... 206/506, 508, 509, 511, 206/512; 220/1.5, 325–328, 254, 85 K, DIG. 6, 235–237

[56] References Cited

U.S. PATENT DOCUMENTS

| | | | |
|---|---|---|---|
| 3,347,412 | 10/1967 | McKinney | 206/511 |
| 3,360,155 | 12/1967 | Colonna | 220/325 |
| 3,406,855 | 10/1968 | McKechnie | 206/509 X |
| 3,666,340 | 5/1972 | Albeanese, III | 220/327 X |
| 3,786,955 | 1/1974 | Mowatt-Larssen | 220/327 |
| 3,858,752 | 1/1975 | Marvin, Jr. et al. | 220/325 |
| 4,378,896 | 4/1983 | Begnaud | 220/327 |
| 4,379,513 | 4/1983 | Basterfield et al. | 220/325 |
| 4,411,372 | 10/1983 | Basterfield et al. | 220/327 |
| 4,643,311 | 2/1987 | Hohlein et al. | 206/508 |
| 4,660,736 | 4/1987 | Mays | 220/327 |
| 4,690,298 | 9/1987 | Scleper | 220/325 |
| 4,746,034 | 5/1988 | Ata et al. | 220/327 X |

FOREIGN PATENT DOCUMENTS

| | | | |
|---|---|---|---|
| 0150395 | 8/1985 | European Pat. Off. . | |
| 476910 | 11/1928 | Fed. Rep. of Germany | 220/235 |
| 3432830 | 7/1985 | Fed. Rep. of Germany . | |
| 333400 | 8/1930 | United Kingdom | 220/235 |
| 1408457 | 10/1975 | United Kingdom | 206/509 |

*Primary Examiner*—Bryon P. Gehman

*Attorney, Agent, or Firm*—Morgan & Finnegan

[57] ABSTRACT

A stackable parallelepipedic container comprises an annular peripheral box-shaped profiled top edge portion (9, 10), which is provided at the top portions of the side walls of the container body and has a top portion for supporting a container cover (13). The container is stable, shockproof structure and can be handled in a simple manner and used to store solid and liquid materials. The container cover (13) consists of a flanged blank having lug-like extensions (22), which protrude from the side edges (21) of the cover and are disposed at right angles about the side edges (21) of the cover. Profiled metal strips (26) are welded to the extensions (22) and constitute an annular peripheral profiled edge portion (40) of the cover. The profiled edge portion (40) of the cover is supported by a peripheral sealing ring (12) on the top portion of the profiled top edge portion of the container body. The profiled edge portion (40) of the cover and the profiled top edge portion of the container body are formed with aligned bores and are clamped against each other by clamp screws (17) extending through the bores. The container cover (13) has a central portion provided with an opening which is closed by another cover (43).

7 Claims, 4 Drawing Sheets

FIG. 4
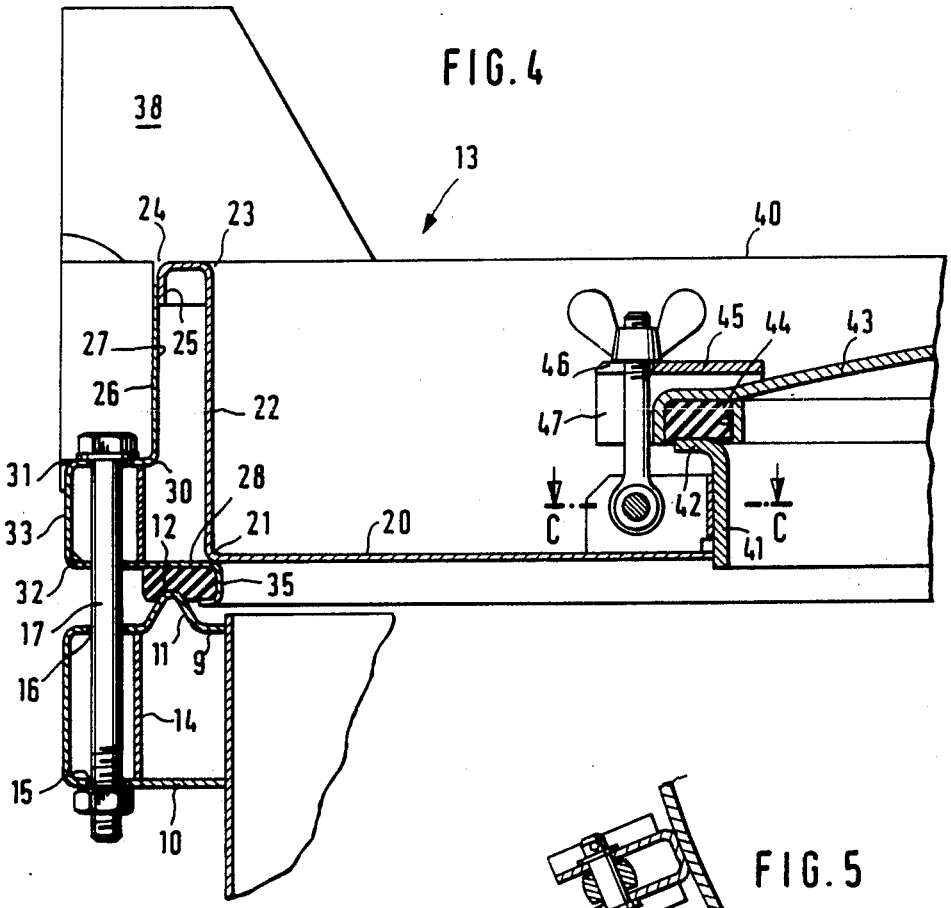
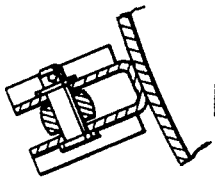
FIG. 5
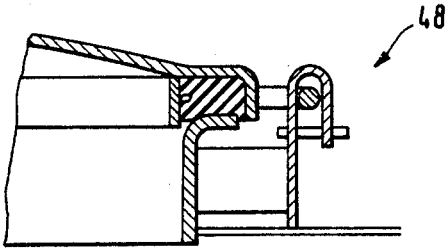
FIG. 6

STACKABLE, STABLE AND SHOCKPROOF PARALLELEPIPEDIC CONTAINER

BACKGROUND OF THE INVENTION

1. Field of the Invention

This invention relates to a stackable parallelepipedic container.

2. Description of the Prior Art

Various embodiments of such containers are known and in dependence on their design are used to hold or store solid or liquid materials. The containers must meet special safety requirements and for this reason must constitute a stable, shockproof structure.

SUMMARY OF THE INVENTION

It is an object of the invention to provide a stackable parallelepipedic container which constitutes a simple, stable and shockproof structure and which can be handled conveniently and can be used to store solid and liquid materials.

In a container of the kind described hereinbefore that object is accomplished in accordance with the invention by providing a container which comprises a container cover which consists of a flanged blank having lug-like extensions that protrude from the side edges of the cover and are angled at right angles about the side edges of the cover. Profiled metal strips are welded to the extensions and constitute an annular peripheral profiled edge portion of the cover. The profiled edge portion of the cover is supported by means of a peripheral sealing ring on the top portion of the profiled top edge portion of the container body. The profiled edge portion of the cover and the profiled top edge portion of the container body are formed with aligned bores and are forced against each other by clamp screws extending through the bores. The container cover is provided with an opening in the central portion which is closed by another cover.

Published German Application 34 32 830 discloses a container which is of the the kind described hereinbefore and which comprises a bottom plate that is provided with an annnular peripheral channel-shaped profiled edge portion which consists of a portion of a flanged blank having lug-like extensions protruding from the edges of the bottom plate and which are separated from each other by right-angled re-entrant corners that have inner portions which are bent down at right angles and outer portions which are bent at right angles about lines that are parallel to the edges of the bottom plate, and the extensions have end edges which define the re-entrant corners and are joined by welding. That known container body also comprises side walls which are joined by welding to the bottom plate and to each other and at their top edges are provided with a channel-shaped profiled top edge portion which as inwardly directed flanges that are welded to the side walls and include a top flange which constitutes a support for the cover of the container.

Depending on their specific design, the containers disclosed in Published German Application 34 32 830 can be used to store solid and liquid materials.

In a container which is of the kind described hereinbefore with reference to the Published German Application 34 32 830 the object set forth hereinbefore is accomplished in a particularly desirable manner by the following features:

the profiled edge portion of the cover is constituted by the lug-like extensions, which have been flanged outwardly and downwardly at right angles about two further lines;

the longitudinal edges of the angle sections are welded to the downwardly directed flanges of the extensions and the angle sections constitute an annular peripheral hollow profiled edge portion of the cover;

the angle sections have an outwardly directed flange or have projections and such flange or projections have bores, which register with bores in the channel-shaped profiled top edge portion of the container body;

the profiled edge portion of the cover is supported by means of a peripheral annular sealing ring on the top flange of the profiled top edge portion of the container; and the profiled edge portion of the cover and the profiled top edge portion of the container body are forced against each other by clamping screws, which extend through the bores.

In that embodiment of the invention the container cover comprises a hollow profiled stiffening edge portion, which in substantial portions consists of the flanged lug-like extensions and which is integral with the cover. The fact that the cover is made of a flanged blank simplifies the manufacture and reduces the costs and results in the formation of the cover with an annular peripheral hollow profiled edge portion, which together with the profiled edge portions at the bottom and at the top of the container body ensures that a container body and cover are stable and shock-proof. In case the container falls from the transport vehicle or falls down for other reasons, the container will always fall on one of the hollow profiled edge portions which are provided at the outer edges of the container. The profiled hollow edge portions can be deformed in that case without deformation of and damage to the container walls. By their deformation the profiled hollow edge portions absorb shock energies so that the latter cannot act on and damage the container walls.

Liquid to be stored in the container can be charged thereto through an opening, which is formed in the container cover and can be closed by another cover. If the container cannot be emptied simply by suction, e.g., because the liquid contains solid residues or because solid materials have been filled into the container, the cover which is in sealing contact with the profiled top edge portion of the container body can be removed so that the entire horizontal cross-section of the container body is then available for removal of the contents from the container body.

To ensure that the container can be emptied completely and in a clean manner, a plastic liner consisting of a plastic bag may be disposed in the container body and may be filled with the material to be stored in the container and that plastic bag can be removed with the entire contents of the container and will ensure that the material stored in the container will not contact the inside surfaces of the latter.

It is apparent that the container in accordance with the invention is of universal utility and owing to its hollow profiled edge portions has shockproof crumple zones.

The top flange of the profiled top edge portion of the container body is suitable formed with an annular peripheral bead which constitutes a sealing surface. The inwardly directed flange of the angle section may extend beyond the portion at which the flange is joined to the side edges of the cover and the extended portions may be flanged outwardly at right angles to the cover plane adjacent to and at a distance from the side edges of the cover so as to form a peripheral annular groove receiving the sealing ring.

In a preferred embodiment, the angle section has spaced apart right-angled portions, which extend outwardly, downwardly and inwardly, respectively, and constitute a hollow rib between the flanges of the angle section. The corner portions of the container cover may be welded to angle members, which protrude above the profiled edge portion of the container cover and are adapted to cooperate with feet of a container which has been placed on the container cover.

In a preferred embodiment the container cover has a central portion, which is formed with a circular opening, and an angle-section ring is welded to the container cover in the opening. The angle section wing has an outwardly directed top flange, which constitutes a sealing surface for engaging a circular second cover, which is hinged and which is held in its closed position by set screws, which are provided with clamping members.

BRIEF DESCRIPTION OF THE DRAWINGS

FIG. 4 is a sectional view taken on line A—A in FIG. 3 and showing on a larger scale the edge portions of the container body and of the container cover.

FIG. 5 is a sectional view taken on line C—C in FIG. 4 and showing a portion of the container cover.

FIG. 6 is a sectional view taken on line B—B in FIG. 3 and showing a portion of the container cover.

DETAILED DESCRIPTION OF THE PREFERRED EMBODIMENT

Figure 1:
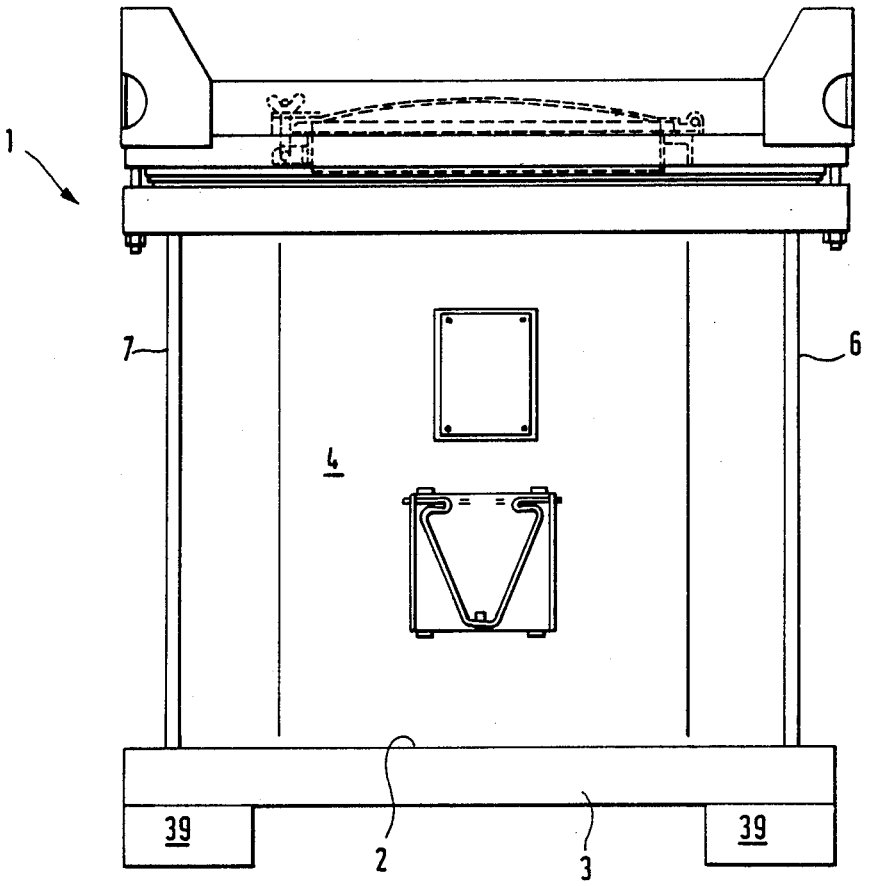
FIG. 1 is a side elevation showing the container.
Figure 2:
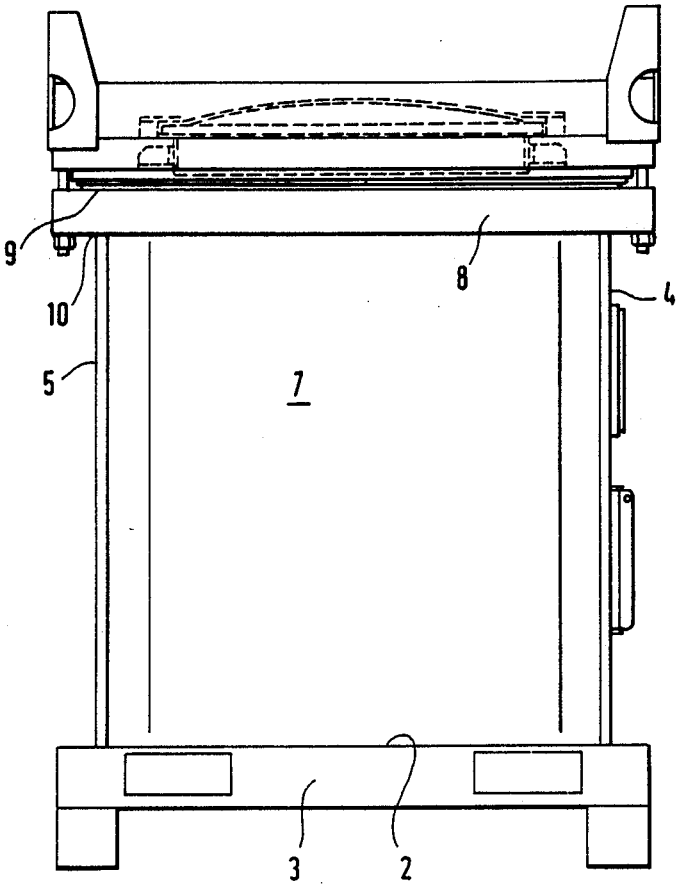
FIG. 2 is a side elevation showing the container viewed from the other side.
Figure 3:
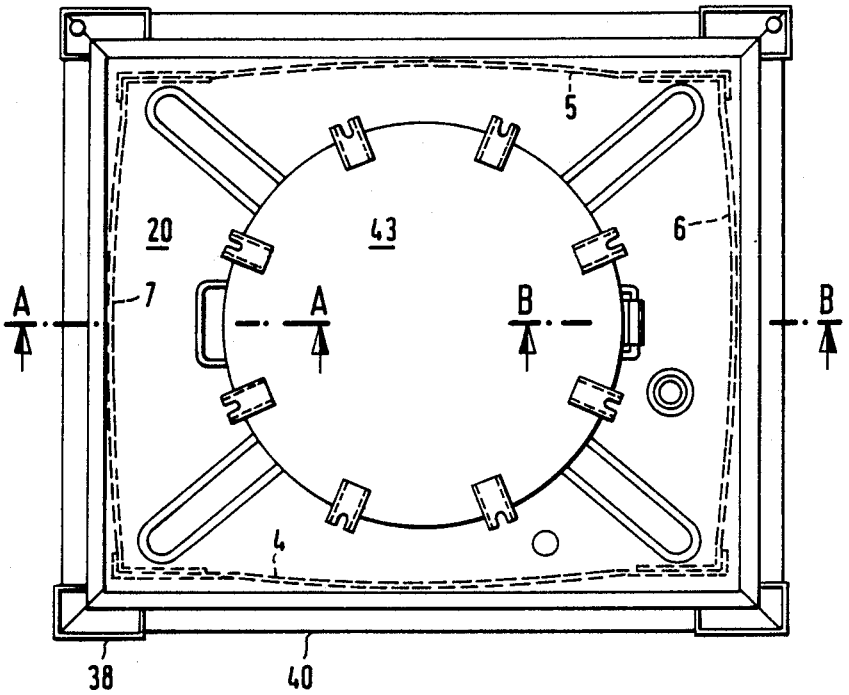
FIG. 3 is a top plan view showing the container of FIGS. 1 and 2.

An illustrative embodiment of the invention will now be described more in detail with reference to the drawings.

The container body 1 comprises a bottom plate 2, which is formed with an annular peripheral channel-shaped profiled edge portion 3. That channel-shaped edge portion constitutes a portion of a flanged blank, which constitutes the bottom plate 2, and comprises lug-like extensions, which protrude from the edges of the bottom and are separated from each other by right-angled re-entrant corners. The extensions have inner portions, which are bent down at right angles, and outer portions, which are bent inwardly at right angles. The inner and outer portions are bent about lines which are parallel to the edges of the bottom. The extensions have end edges, which define the re-entrant corner portions and are joined by welding. That design of the bottom plate has been described in detail in Published German Application 34 32 830 with reference to FIGS. 10 to 14 thereof and is not described in detail herein but the disclosure of Published German Application 34 32 830 is incorporated herein by reference.

The side walls 4, 5, 6, 7 of the container body 1 stand on the bottom plate 2 at right angles thereto and have bottom edges which are welded to the bottom plate. Each of the side edges of the side walls 4 to 7 is provided with a flange, which overlaps the adjacent edge portion of an adjacent side wall.

At such flanges the side walls of the container are joined by welding.

The top edge portion of the container body is formed with an annular peripheral channel-shaped profiled stiffening top edge portion 8. The channel-shaped top edge portion 8 has inwardly directed flanges 9, 10, which are welded to the top portions of the side walls 4 to 7. The design of the profiled top edge portion of the container body has been described in Published German Application 34 32 830 with reference to FIGS. 4 to 6 thereof. A difference from that disclosure resides in the fact that the top flange 9 of the channel-shaped top edge portion 8 is formed with an upwardly convex, annular peripheral bead 11, which constitutes a sealing surface in contact with the sealing ring 12 provided on the container cover 13 and consisting of rubber or elastomer. A reinforcing strip 14 is incorporated by welding in the annular peripheral profiled top edge portion 8. Finally, the outer portions of the flanges 9, 10 of the profiled top edge portion 8 of the container body are formed with bores 15, 16 for receiving clamp screws 17.

The container cover 13 consists of a flanged blank and comprises a top 20 and lug-like extensions 22, which extend outwardly from the side edges 21 of the cover. The lug-like extensions 22 are bent approximately at right angles about the side edges of the cover and are bent at right angles about two further lines 23, 24 in outward and downward directions, respectively. Cutouts are provided between the lug-like extensions 22 so that the vertical edges of the extensions 22 adjoin each other and can be joined by welding. Gaps exist between those end portions of the extensions 22 which have been angled the directions of the lines 23, 24 and these gaps are closed by fitting members which are secured by welding. A flanged metal strip 26 is joined by welding to the depending flanges 25 of the extensions 22 and to the edge portions 21 of the cover. The strip 26 comprises an upstanding flange 27, which is welded to the flange 25, and another flange 27, which is at right angles to the flange 27 and is welded to the adjacent side edge 21 of the cover. Between the flanges 27, 28, the flanged strip 26 is flanged about the lines 30, 31, 32 and is thus provided with an outwardly offset hollow rib 33, which in its horizontal flange is formed with bores, which are aligned with the bores 15 and 16, when the cover 13 has been mounted in the container. The cover can then be clamped against the container by clamp screws 17 extending through the bores.

The lower horizontal flange 28 of the profiled strip 26 is extended beyond that portion thereof which is welded to the adjacent side edges 21 of the cover. That extended portion 35 is angled downwardly adjacent to the side edges of the cover and outwardly at a distance from the side edges of the cover. An annular peripheral groove is thus formed and the sealing ring 12 is retained in is groove.

Angled sheet metal elements 38 are welded in the corner portions of the cover 13 to the annular peripheral cover flange 33. These sheet metal elements serve to cooperate with feet of a container which has been placed on the cover 13. The feet 39 are welded to the profiled bottom edge portions 3 and bear on the top edge of the profiled edge portion 40 of the cover and are laterally retained by the angle members 38.

The top 20 of the container cover is formed with a centrally disposed, circular opening, in which an angle-section ring 41 is welded to the cover. Ring 41 comprises an outwardly directed top flange 42, which constitutes a sealing surface in contact with a second circular cover 43. The latter is formed in its undersurface with an annular peripheral groove, in which a sealing ring 44 of rubber or elastomeric material is retained. Retaining members 45 are welded to the cover 43 and are formed with slots 46, which have open outer ends and which are adapted to receive wing screws 47, which are pivoted to the top 20 of the cover and can be swung inwardly into the slots 46. A hinge 48 connects the second cover 43 to the top 20 of the container cover 13.

I claim:

1. A stackable parallelepipedic container comprising a container body having a plurality of side walls, a bottom portion and a top portion, an annular peripheral box-shaped profiled top edge portion located at the top portion of said side walls of said container body and a container cover located on said top portion, characterized in that said container cover consists of a flanged blank having lug-like extensions which protrude from the side edges of the cover and are angled at right angles about the side edges of said cover; profiled metal strips welded to said lug-like extensions and forming an annular peripheral profiled edge portion of said cover; the said profiled edge portion of said cover being supported by a peripheral sealing ring disposed on the top portion of the profiled top edge portion of said container body; said profiled edge portion of said cover and said profiled top edge portion of said container body being provided with aligned bores and being forced against each other by clamp screws extending through said bores; and said container cover having a central portion provided with an opening which is closed by another cover.

2. A container according to claim 1, wherein the bottom portion is a plate provided with annular peripheral channel-shaped profiled edge portion which consists of a portion of a flange blank having lug-like extensions protruding from the edge thereof and which are separated from each other by right-angled re-entrant corners and have inner portions which are bent down at right angles and outer portions which are bent at right angles about lines which are parallel to the edge of said plate, and said lug-like extensions have end edges which define said re-entrant corners and are joined by welding, said container comprises side walls which are joined by welding to said plate and to each other, and at their top edges are provided with channel-shaped profiled top edge portions, which have inwardly directed flanges which are welded to the side walls and include a top flange which forms a support for the cover of said container, the profiled edge portion of said cover being formed by the lug-like extensions which are flanged outwardly and downwardly at right angles about two further lines forming L-shaped sections; the longitudinal edges of said L-shaped sections being welded to the downwardly flanged lug-like extensions and said L-shaped sections forming an annular peripheral hollow profiled edge portion on the cover; the L-shaped sections have outwardly directed flanges or projections provided with bores, which register with bores in the channel-shaped profiled top edge portion of said container body; said profiled edge portion of said cover being supported by a peripheral annular sealing ring disposed on the top flange of the profiled top edge portion of said container.

3. A container according to claim 2, wherein the L-shaped sections have inwardly directed flanges which extend beyond the portion of the cover at which said flanges are joined to the side edges of said cover and the extended portions of the flanges are flanged outwardly at right angles to the cover plane adjacent to and at a distance from the side edges of said cover so as to form a peripheral annular groove receiving the sealing ring.

4. A container according to claim 2, wherein the L-shaped sections have right-angled portions which extend outwardly, downwardly and inwardly, respectively, and constitute a hollow rib between the flanges of the L-shaped sections.

5. A container according to claim 1, wherein the top portion of the profiled top edge portion of the container body is formed with an annular peripheral bead which forms a sealing surface.

6. A container according to claim 1, wherein the container cover includes corner portions which are welded to angle members which protrude above the profiled edge portion of said container cover and which are adapted to cooperate with feet on a container which has been placed on the container cover.

7. A container according to claim 1, wherein the central portion of the container cover is provided with a circular opening, and an angle-section ring welded to said container cover is disposed in said opening, the ring having an outwardly directed top flange, which forms a sealing surface for engaging a circular second cover disposed in said circular opening and which is hingedly connected to said container cover and is held in its closed position by set screws which are provided with clamping members located on said container cover

* * * * *